United States Patent [19]

Okamura et al.

[11] Patent Number: 4,472,493

[45] Date of Patent: Sep. 18, 1984

[54] PHOTOGRAPHIC ELEMENTS WITH DEVELOPMENT INHIBITOR PRECURSORS

[75] Inventors: Hisashi Okamura; Yukio Maekawa; Yukio Karino, all of Kanagawa, Japan

[73] Assignee: Fuji Photo Film Co., Ltd., Kanagawa, Japan

[21] Appl. No.: 560,053

[22] Filed: Dec. 9, 1983

[30] Foreign Application Priority Data

Dec. 10, 1982 [JP] Japan ..... 57-216689

[51] Int. Cl.[3] ..... G03C 5/54; G03C 1/34; G03C 1/40

[52] U.S. Cl. ..... 430/219; 430/544; 430/559; 430/611; 430/957; 430/960

[58] Field of Search ..... 430/219, 382, 445, 544, 430/559, 611, 957, 960

[56] References Cited

U.S. PATENT DOCUMENTS 4,009,029 2/1977 Hammond et al. ..... 430/219
4,246,333 1/1981 Fuseya et al. ..... 430/219
4,355,101 10/1982 Mehta et al. ..... 430/219

FOREIGN PATENT DOCUMENTS 3014672 11/1980 Fed. Rep. of Germany ..... 430/219
138745 10/1980 Japan ..... 430/219

*Primary Examiner*—Richard L. Schilling
*Attorney, Agent, or Firm*—Sughrue, Mion, Zinn, Macpeak & Seas

[57] ABSTRACT

A photographic element is disclosed which is comprised of a support having thereon a light-sensitive silver halide emulsion which is associated with a development inhibitor precursor. The precursor is represented by the general formula [I]

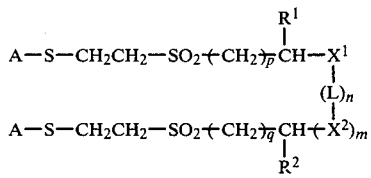

[I]

the substituents within the general formula are defined within the specification. By utilizing the development inhibitor precursor of the invention the resulting photographic element provides images having high quality and excellent processing temperature characteristics.

13 Claims, No Drawings

PHOTOGRAPHIC ELEMENTS WITH DEVELOPMENT INHIBITOR PRECURSORS

FIELD OF THE INVENTION

This invention relates to a photographic element. More specifically, this invention relates to a photographic element using a novel development inhibitor precursor and particularly a color diffusion transfer photographic element.

BACKGROUND OF THE INVENTION

The use of development inhibitors or development inhibitor precursors in photographic elements for color diffusion transfer photographic processes are disclosed in, for example, Weyerts et al, U.S. Pat. No. 3,260,597; Rogers, U.S. Pat. No. 3,265,498; Hammond et al, U.S. Pat. No. 4,009,029; Fuseya et al, Japanese Patent Application (OPI) No. 130929/79; Uemura et al, Japanese Patent Application (OPI) No. 138745/80 (the term "OPI" indicates an unexamined published patent application open to public inspection), etc. Some of the compounds disclosed in the foregoing patents and unexamined published patent applications inhibit not only the unnecessary development but also the necessary development, which causes a reduction of image quality while other compounds give insufficient release of development inhibitors at high temperatures, whereby an increase of the minimum density and the decrease of the sensitivity cannot be restrained. Furthermore, the incorporation of these compounds in photographic elements, in particular, in so-called neutralization timing layers of color diffusion transfer photographic elements is accompanied by the delay of the neutralization timing time. The delay of the neutralization timing reduces the sharpness of a transferred color image which causes a reduction in image quality. As described above, there are no proper conventional compounds which can restrain the increase of the minimum density and not reduce the image quality of transferred color images without reducing the maximum density.

SUMMARY OF THE INVENTION

A primary object of this invention is, therefore, to provide a color diffusion transfer photographic element which provides high image quality.

Another object of this invention is to provide a color diffusion transfer photographic element having excellent processing temperature characteristics.

Yet another object of this invention is to provide a color diffusion transfer photographic element using a novel development inhibitor precursor.

As the result of various investigations, the inventors have discovered that the above objects of this invention can be attained by a photographic element, comprising a support having thereon a light-sensitive silver halide emulsion having associated therewith a novel development inhibitor precursor represented by following general formula [I]

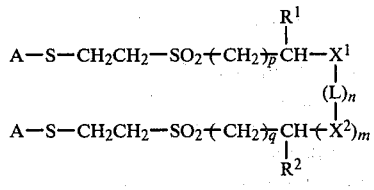

[I]

wherein A represents a substituted or unsubstituted phenyl group or a 5- or 6-membered nitrogen-containing heterocyclic ring; $R^1$ and $R^2$, which may be the same or different, each represents a hydrogen atom or an alkyl group having 1 to 4 carbon atoms; p and q, which may be the same or different each is 0 or an integer of 1 to 3; $X^1$ and $X^2$, which may be the same or different, each represents an ester bond, a substituted or unsubstituted amido bond, or an ether bond; when said $X^1$ and $X^2$ are amido groups, the substituents on the nitrogen atoms may combine with each other to form a heterocyclic ring together with L and the moiety of each $X^1$ and $X^2$; L represents an alkylene group, a phenylene group or a xylylene group; and n and m each is 0 or 1.

DETAILED EXPLANATION OF THE INVENTION

The development inhibitor precursors used in this invention will now be described in detail.

The amido bond shown by $X^1$ and $X^2$ in the foregoing general formula also includes a sulfonamido group. The heterocyclic ring constituted by L and the moiety of each $X^1$ and $X^2$ may be substituted.

Examples of the foregoing heterocyclic ring are a perhydrotriazine ring, an imidazolidine ring, a piperazine ring, a perhydropyrimidine ring, etc., and in particular, a perhydrotriazine can be substituted.

Examples of the phenyl group shown by A in the foregoing general formula are an alkyl group (preferably, having 1 to 4 carbon atoms, such as methyl group, ethyl group, etc.), an alkoxy group (preferably, having 1 to 4 carbon atoms, such as methoxy group, ethoxy group, etc.), a nitro group, a halogen atom (e.g., chlorine atom), an alkoxycarbonyl group (preferably, having 1 to 4 carbon atoms of the alkyl moiety, e.g., methoxycarbonyl group, ethoxycarbonyl group, etc.), a substituted or unsubstituted carbamoyl group (preferred examples of the substituents are an alkyl group having 1 to 4 carbon atoms or a phenyl group), and a substituted or unsubstituted sulfamoyl group (preferred examples of the substituent are an alkyl group having 1 to 4 carbon atoms or a phenyl group).

The nitrogen-containing heterocyclic ring shown by A may be condensed with a benzene ring or may be substituted by an ordinary substituent [e.g., an alkyl group (e.g., methyl group, ethyl group, etc.); a phenyl group; a substituted phenyl group such as an alkoxyphenyl group (e.g., ethoxyphenyl group, etc.), a phenoxycarbonyl-phenyl group and a sulfamoylphenyl group; etc.]. Examples of the nitrogen-containing heterocyclic ring are a tetrazole ring such as a tetrazole ring, a phenyltetrazole ring, etc.; a triazole ring such as a benzotriazole ring, 1,2,4-triazole ring, etc,; diazole ring such as a benzimidazole ring, an imidazole ring, etc., a pyrimidine ring such as a pyrimidine ring, etc.; and a monoazole ring such as a benzothiazole ring, a benzoxazole ring, etc. Nitrogen-containing heterocyclic rings each having at least two hetero atoms, such as a tetrazole ring, a benzotriazole ring, a benzothiazole ring, etc., are preferred and tetrazoles, in particular a phenyltetrazole ring are more preferred.

A preferred embodiment of this invention includes a color diffusion transfer photographic element comprising a support having thereon at least one light-sensitive silver halide emulsion layer having associated therewith a dye image-providing compound, and a same or different support from the above-said support, having thereon an image-receiving layer, the photographic element containing the developer inhibitor precursor wherein said development inhibitor precursor is the compound shown by foregoing general formula [I].

In more preferred embodiment of this invention, the photographic element containing at least one of the development inhibitor precursors shown by foregoing general formula [I] includes a color diffusion transfer photographic element comprising a light-sensitive element composed of a support and at least one silver halide emulsion layer having associated therewith a dye image-providing compound; an image-receiving element for fixing the diffusible dye formed from said dye image-providing compound to form an image; another hydrophilic colloid layer, if desired; an alkali processing composition for developing the foregoing imagewise exposed light-sensitive element; and a neutralizing system for neutralizing the alkali processing composition, if necessary.

In still another preferred embodiment of this invention, the color diffusion transfer photographic element containing at least one development inhibitor precursor shown by general formula [I] includes a color diffusion transfer photographic element which comprises a light-sensitive sheet comprising a transparent support having thereon an image-receiving element for fixing diffusible dyes to form color images, a white reflecting layer, a light-shielding layer and a light-sensitive element comprising at least one silver halide emulsion layer having associated therewith a dye image-providing compound; an alkali processing composition for developing the aforesaid imagewise exposed light-sensitive element; and a cover sheet comprising another support having thereon a neutralizing system, for neutralizing the foregoing alkali processing composition.

The invention is further explained in more detail.

Preferred compounds in the compounds shown in foregoing general formula [I] are the compounds shown by the following general formula [II]

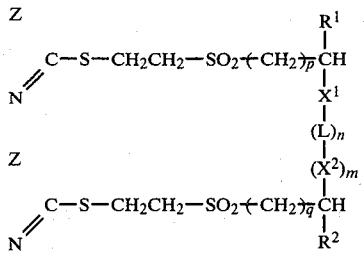

[II]

wherein Z represents a non-metallic atomic group necessary for completing a 5- or 6-membered nitrogen-containing hetercyclic ring, preferably a tetrazole ring, more preferably a 1-phenyltetrazole ring; $R^1$, $R^2$, $X^1$, $X^2$, L, m,n, p, and q have the same significance as defined in general formula [I]; said p and q being preferably 1; said $R^1$ and $R^2$ being preferably a hydrogen atom; said L being preferably an alkylene group having 1 to 6 carbon atoms (e.g., methylene group, ethylene group, trimethylene group, hexamethylene group, etc.), a phenylene group, or a xylylene group; and said $X^1$ and $X^2$ being preferably an amido bond or an ether bond. When both said $X^1$ and $X^2$ represent an amido group, it is preferred that both said n and m are 1 and in this case the compounds shown by the following general formula [III] are particularly preferred;

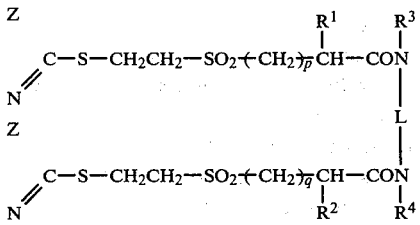

[III]

wherein Z, $R^1$, $R^2$, L, p and q have the same significance as defined in general formula [II]; and $R^3$ and $R^4$ each represents a hydrogen atom, an alkyl group having 1 to 4 carbon atoms (e.g., methyl group, ethyl group, isopropyl group, butyl group, etc.,), or a phenyl group. Also, said $R^3$ and $R^4$ may combine with each other to form a heterocyclic ring together with L and two nitrogen atoms.

Preferred examples of the compound in this case are the compounds shown by following general formula [IV]. Also, the heterocyclic ring may be further substituted and preferred examples in this case are the compouds shown by the following general formula [V]:

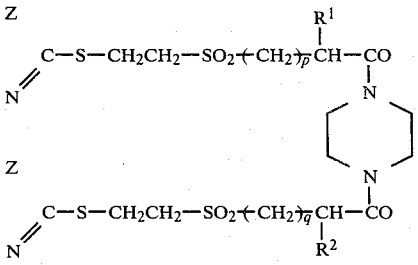

[IV]

-continued

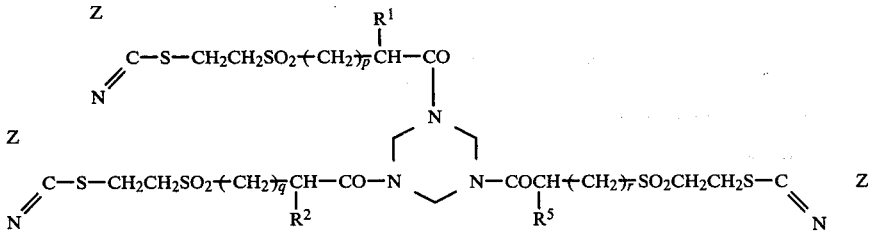

[V]

wherein Z, $R^1$, $R^2$, p, q have the same significance as defined in general formula [II]; r is 0 or 1; and $R^5$ represents a hydrogen atom or a methyl group.

When $X^1$ is an ether bond, both n and m are preferably 0 and in this case the compounds shown by following general formula [VI] are particularly preferred.

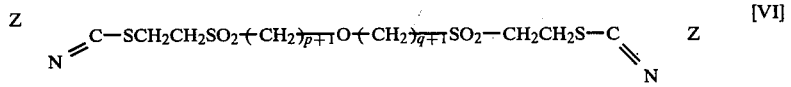

[VI]

in general formula [VI], Z, p and q have the same significance as defined in general formula [II].

In foregoing general formulae [I] to [IV] and [VI], it is preferred that p is equal to q and in general formula [V], it is preferred that p, q, and r are equal to each other.

The development inhibitor precursor useful in this invention splits in an alkali processing solution to release a development inhibitor which is diffusible in an alkali solution.

Preferred examples of the compound advantageously used in this invention are illustrated below:

Compound 1

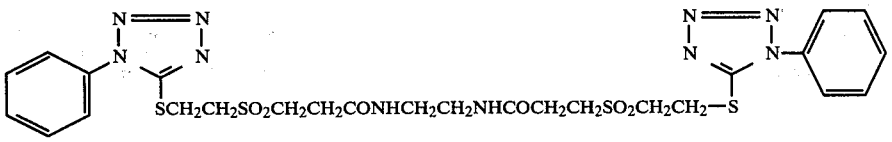

Compound 2

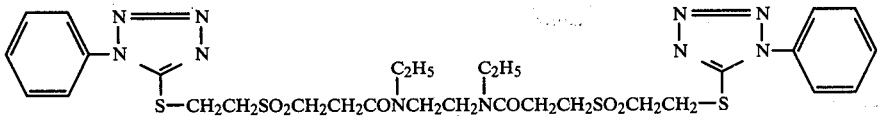

Compound 3

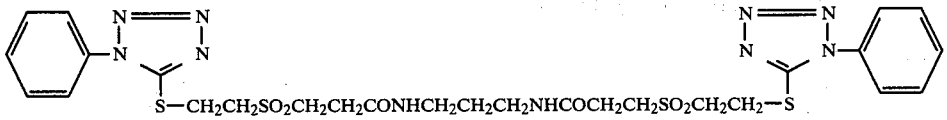

Compound 4

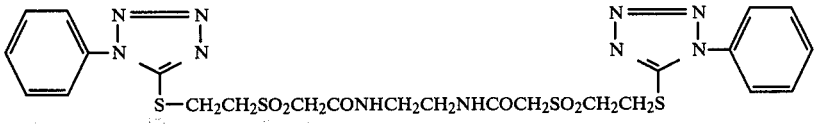

Compound 5

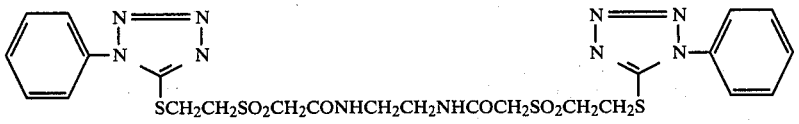

Compound 6

-continued

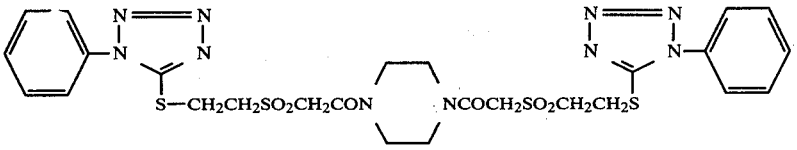

Compound 7

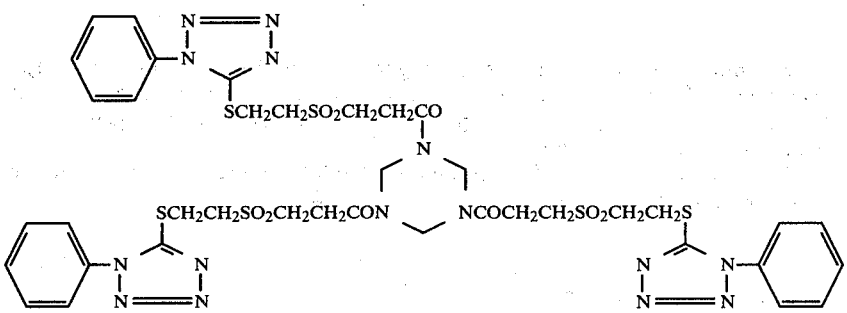

Compound 8

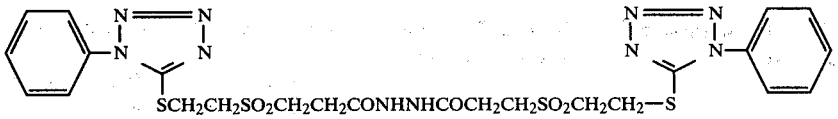

Compound 9

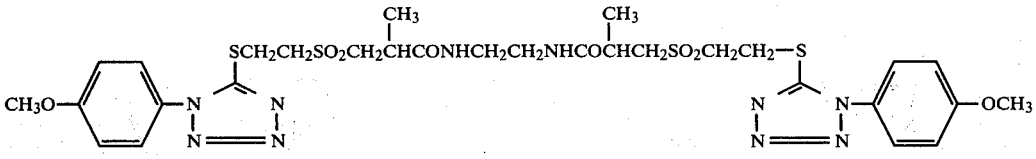

Compound 10

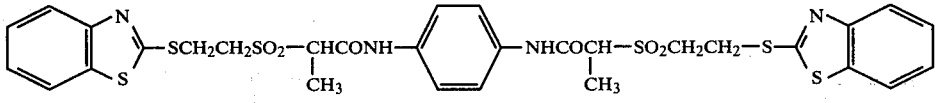

Compound 11

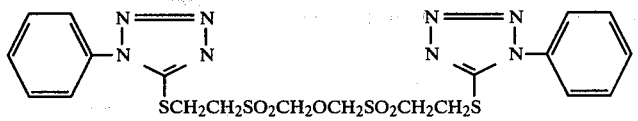

Compound 12

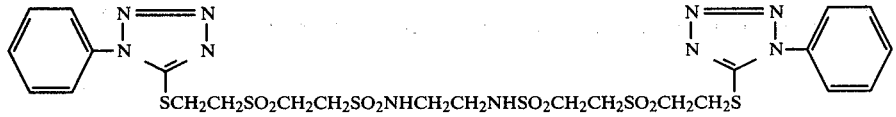

Particularly preferred examples of the compound advantageously used in this invention are Compound 5 and Compound 11.

These compounds are prepared by adding thiols shown by the following general formula [VIII] to the compounds having two or more vinylsulfonyl groups in one molecule shown by following general formula [VII];

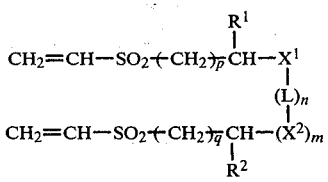

[VII]

$$A-SH \qquad [VIII]$$

wherein A, L, $X^1$, $X^2$, $R^1$, $R^2$, p, q, n, and m have the same significance as defined in general formula [I].

Also, a compound having two or more vinylsulfonyl group in one molecule thereof as shown in general formula [VII] is well known as a hardening agent for a gelatin binder in the field of photography and the production processes of these compounds are described in detail in, for example, Japanese Patent Publication No. 35807/75; Japanese Patent Application (OPI) Nos. 41221/78 and 30022/79; U.S. Pat. No. 3,642,486, etc.

Examples of the addition reaction of the thiol shown by formula [VIII] to the compound of formula [VII] are shown below.

Synthesis example of Compound 2:

To 2.4 g of 1,2-bis-(N-ethyl-3-vinylsulfonylpropionamido)ethane were added 2.2 g of 1-phenyl-5-mercaptotetrazole, 1.0 g of sodium acetate, and 10 ml of acetic acid and the mixture was stirred for 3 hours under heating to 60° to 70° C. To the mixture was added 100 ml of ethyl acetate, and the ethyl acetate solution thus formed was washed twice each time with 100 ml of water, dried by magnesium sulfate, concentrated, and the residue was purified by column chromatography (silica gel, developing solvent:ethyl acetate) to provide 1.9 g of Compound 2 as a colorless semi-wax form liquied. The yield was 42% of the theoretical value. The structure of the compound was confirmed by NMR spectra and IR spectra.

Synthesis of Compound 4:

To 6.5 g of 1,2-bis(vinylsulfonylacetamido)ethane were added 8.9 g of 1-phenyl-5-mercaptotetrazole 4.1 g of sodium acetate, and 40 ml of acetic acid and the mixture was stirred for 3 hours under heating to 75° to 80° C. Then, after adding thereto 100 ml of methanol, the mixture was ice-cooled to precipitate crystals, which were collected by filtration and recrystallized from 150 ml of acetonitrile to provide Compound 4. The amount of the product was 10.2 g, which was 75% of the theoretical value. The melting point of the product was 155° to 156° C. The structure of the product was confirmed by NMR spectra and IR spectra.

Synthesis of Compound 5:

To 6.1 g of 1,3-bis(vinylsulfonylacetamido)propane were added 7,1 g of 1-phenyl-5-mercaptotetrazole, 3.2 g of sodium acetate, and 30 ml of acetic acid and the mixture was stirred for 2 hours under heating to 60° C. Thereafter, after adding thereto 63 ml of ethyl acetate and 27 ml of water, the resultant mixture was ice-cooled to precipitate crystals, which were collected by filtration and recrystallized from 45 ml of acetone to provide Compound 5. The amount of the product was 7.6 g, which was 61% of the theoretical value, and the melting point of the product was 81° to 82° C. The structure of the product was confirmed by NMR spectra and IR spectra.

Synthesis of Compound 7:

To 3.2 g of 1,3,5-tris-(3-vinylsulfonylpropionyl)-1,3,5-perhydrotriazine were added 3.2 g of 1-phenyl-5-mercaptotetrazole, 1.5 g of sodium acetate, and 15 ml of acetic acid and the mixture was stirred for 4 hours under heating to 60° to 70° C. After adding thereto 300 ml of methanol, the mixture was allowed to cool to form crystals, which were collected by filtration and purified by column chromatography (silica gel, developing solvent: ethyl acetate/acetone=9/1) to provide Compound 7. The amount of the product was 5.7 g, which was 90% of the theoretical value, and the melting point thereof was 72° to 76° C. The structure of the compound was confirmed by NMR spectra and IR spectra.

Synthesis of Compound 8:

To 2.0 g of N,N'-bis-(3-vinylsulfonylpropionyl)hydrazine were added 2.2 g of 1-phenyl-5-mercaptotetrazole, 1.0 g of sodium acetate, and 20 ml of acetic acid and the mixture was stirred for 3.5 hours under heating to at 60° to 70° C. After adding thereto 200 ml of methanol, the mixture was allowed to cool to form crystals, which were collected by filtration and recrystallized from 100 ml of acetonitrile to provide Compound 8. The amount of the product was 2.1 g, which was 51% of the theoretical value, and the melting point thereof 162° to 163° C. The structure of the product was confirmed by NMR spectra and IR spectra.

Synthesis of Compound 11:

To 6.8 g of bis(vinylsulfonylmethyl)ether were added 10.7 g of 1-phenyl-5-mercaptotetrazole, 4.9 g of sodium acetate, and 50 ml of acetic acid and the mixture was stirred for 3 hours under heating to 60° to 70° C. After adding thereto 200 ml of ethyl acetate, the mixture was allowed to cool to form crystals, which were collected, washed with water, and recrystallized from acetonitrile to provide desired Compound 11. The amount of the product was 13.4 g, which was 76% of the theoretical value, and the melting point of the product was 135° to 136° C. The structure of the product was confirmed by NMR spectra and IR spectra.

In general, when a development inhibitor precursor is associated with a so-called neutralization timing layer of a color diffusion transfer photographic element, the neutralization timing time is frequently delayed but the correspondence of such a delay to the structure of the development inhibitor precursor has not yet been clarified. Since the delay of the neutralization timing time causes the reduction in image quality such as sharpness, the production of the development inhibitor precursor causing no delay of the neutralization timing has been desired. When the compound of this invention is used, a high quality transferred image is obtained without almost any delay in the neutralization timing. Accordingly, there is obtained an advantage never expected in view of similar structures of the development inhibitor precursors of this invention to conventional compounds, for example, as discribed in Japanese Patent Application (OPI) No. 138745/80.

The development inhibitor precursor of general formula [I] used in this invention may be used solely or may be used together with other conventional development inhibitor precursor.

As the neutralizing timing layer, ordinary known timing layers may be used in this invention. Useful materials for the timing layer are a polymer having a low alkali permeability, such as polyvinyl alcohol, cellulose acetate, partially hydrolyzed polyvinyl acetate, etc.; a polymer prepared by copolymerizing a small amount of a hydrophilic comonomer such as an acrylic acid monomer, etc.; a polymer having a lactone ring, etc.

Examples of particularly useful polymers for the neutralization timing layer used in this invention are cellulose acetates disclosed in Japanese Patent Application (OPI) Nos. 136328/79 and 130926/79; U.S. Pat. Nos. 4,009,030; 4,029,849; etc.; polymers prepared by copolymerizing a small amount of a hydrophilic comonomer such as acrylic acid, etc., as disclosed in Japanese Patent Application (OPI) Nos. 145217/77; 72622/78; 78130/79; 138433/79; 138432/79; and 128,335/79; U.S. Pat. No. 4,061,496, etc.; and polymers having a lactone ring disclosed in Japanese Patent Application (OPI) No. 54341/80; *Research Disclosure,* No. 18452 (1979), etc.

Other polymers used in this invention for the neutralization timing layer are also described in U.S. Pat. Nos. 3,455,686; 4,009,030; 3,785,815; and 4,123,275; Japanese Patent Application (OPI) Nos. 92022/73; 64435/74; 22935/74; 77333/76; 2431/77; and 88330/77; Japanese Patent Publication Nos. 15756/69; 12676/71; and 41214/73; West German Patent Applications (OLS) Nos. 1,622,936 and 2,162,277; *Research Disclosure,* 15,162 No. 151 (1976), etc.

The release of a development inhibitor from the development inhibitor precursor of this invention can be attained by the contact with an alkaline medium according to this invention but may be attained or assisted by increasing the environmental temperature for taking photograph.

The development inhibitor precursor of this invention can be advantageously used for photographic materials having ordinary silver halide emulsion layers in addition to the foregoing diffusion transfer photographic materials.

When the compound of this invention is incorporated in a photographic material, it causes less reduction of the photographic properties of the photographic material during presevation. Further it does not reduce the sensitivity of the photographic material at exposure, and releases a mercapto compound, which acts as an antifoggant, during development to effectively reduce the formation of fog. The compound of this invention can inhibit the formation of fog in a quick development using silver halide emulsions having a high developing speed, silver halide emulsions associated with development accelerator or couplers having high reactivity, a developer having a high pH, or a high development temperature. The precursor of this invention is innert to silver halide emulsions and changes very little even under severe strong conditions which photographic materials encounter.

When the photographic element is applied to a color diffusion transfer photographic process, the photographic element may take a form such as a peel apart-type structure, an integrated-type structure as described in Japanese Patent Publication Nos. 16356/71 (corresponding to U.S. Pat. Nos. 3,415,645 and 3,415,646) and 33697/73 (corresponding to U.S. Pat. No. 3,594,164); Japanese Patent Application (OPI) No. 13040/75 (corresponding to U.S. Pat. No. 3,393,486); and British Pat. No. 1,330,524; or a peel apart unnecessary-type film unit as descrived in Japanese Patent Application (OPI) No. 119345/82.

In any formats of the foregoing types, it is advantageous in order to widen the allowable range of processing temperature, to use a polymer acid layer protected by the neutralization timing layer.

A preferred embodiment of this invention includes a photographic element comprising a support having thereon at least one silver halide emulsion layer having associated therewith the development inhibitor precursor of this invention shown by the foregoing formula [I] so that the precursor can act effectively.

In a very preferred embodiment of this invention, the photographic element comprises;

(1) a light-sensitive layer comprising at least one layer containing a silver halide emulsion associated with a dye image-providing compound, (2) an image-receiving layer, (3) a system for releasing an alkaline processing composition containing a silver halide developing agent, (4) a neutralizing system having a neutralizing layer associated with, if necessary, a neutralization timing layer, and (5) the development inhibitor precursor shown by general formula [I] added for effectively acting on the development of the foregoing silver halide emulsion or emulsions.

The development inhibitor precursor shown by the foregoing general formula [I] may be incorporated in any layer if the precursor is associated such that it will effectively act on the development of silver halide emulsions and is preferably incorporated in a light-sensitive element such as a silver halide emulsion-containing layer, a dye image-providing compound-containing layer, or other auxiliary layer(s); an image-receiving element such as an image-receiving layer and auxiliary layer(s), e.g., a white reflecting layer; or a neutralizing system such as a neutralizing layer and a neutralization timing layer. It is particularly preferred that the precursor of this invention be incorporated in the neutralizing layer or the neutralization timing layer.

The addition amount of the foregoing development inhibitor precursor used in a diffusion transfer process depends upon the amount of a developing agent, the developing condition, the composition of the silver halide emulsion-containing layer, etc., but is usually at least $10^{-5}$ mol, preferably from $10^{-4}$ mol to $10^{-1}$ mol based on one mol of silver.

The development inhibitor precursor of this invention can be incorporated in a form of dispersion in a desired layer by any technically possible and effective manner. In a certain preferred embodiment, the development inhibitor precursor can be incorporated as a solution in an organic solvent such as acetone or may be dissolved in a high-boiling solvent such as a water-insoluble coupler solvent and then added to a carrier material as the emulsified dispersion of the solution. Typical examples of useful coupler solvents include liquid dye stabilizers as described in "Product Licensing Index"; Vol. 83, published March 1971, a report entitled "Improved Photographic Dye Image Stabilizers-Solvent" and proper polar solvent such as tri-o-cresyl phosphate, di-n-butyl phthalate, diethyllaurylamide, 2,4-diarylphenol, etc. Furthermore, in another preferred embodiment, the development inhibitor precursor is directly dissolved in a coating solution using an organic solvent when coating the coating solution for forming, for example, a neutralizing layer, a neutralization timing layer, etc.

The incorporation method of the development inhibitor precursor of this invention is not limited to the foregoing. Other methods may be employed.

The light-sensitive silver halide emulsion used in this invention is a hydrophilic colloid dispersion of silver chloride, silver bromide, silver cholorobromide, silver iodobromide, silver chloroiodobromide, or a mixture of them. The halogen composition of the silver halide emulsion used in this invention is suitably selected according to the end use of the photographic material and the processing conditions but silver bromide, silver iodobromide, or silver chloroiodobromide having an iodide content of less than 10 mol% and a chloride content of less than 30 mol% is particularly preferred.

The present invention can be applied to a negative-type silver halide emulsion forming a surface latent image or a direct reversal-type silver halide emulsion and of the latter type emulsions, there are an internal latent image-type silver halide emulsion and a previously fogged direct reversal silver halide emulsion.

In this invention an internal latent image-type silver halide emulsion can be more advantageously used and as such silver halide emulsions, there are conversion-type silver halide emulsions, core/shell-type silver halide emulsions, silver halide emulsions containing foregin metals as described in, for example, U.S. Pat. Nos. 2,592,250; 3,206,313; 3,447,927; 3,761,276; and 3,935,014.

Typical examples of nucleating agents for this type of silver halide emulsions are hydrazines described in U.S. Pat. Nos. 2,588,982 and 2,563,785; hydrazides and hydrazones described in U.S. Pat. No. 3,227,552; quaternary salt compounds described in British Pat. No. 1,283,835; Japanese Patent Publication No. 38164/74; and U.S. Pat. Nos. 4,115,122; 3,734,738; 3,719,494; and 3,615,615; sensitizing dyes having a nucleating substitutuent having a fogging action in the dye molecule described in U.S. Pat. No. 3,718,470; and thiourea-connection-type acylhydrazine series compounds as described in U.S. Pat. Nos. 4,030,925; 4,031,127; 4,245,037; 4,255,511; 4,266,013; 4,276,364, etc.

The silver halide emulsions used in this invention can have, if desired, color sensitivities widened by spectral sensitizing dyes. As such spectral sensitizing dyes, cyanine dyes and merocyanine dyes, etc., may be properly used.

The dye image-providing compound used in this invention is of a negative-type or a positive-type as is known for persons skilled in the art, that is the dye image-providing compound is, when processed with an alkaline processing composition, first mobile or immobile in the photographic element.

As the negative-type dye image-providing compound useful in this invention, there is a coupler which forms or releases a dye by causing a reaction with an exidized color developing agent. Practical examples of the coupler are described in U.S. Pat. No. 3,227,550, Canadian Pat. No. 602,607.

As the preferred negative-type dye image-providing compound used in this invention, there is a dye-releasing redox compound which releases a dye by causing a reaction with a developing agent in an exidized state or an electron transferring agent. Practical examples of the compound are described in, for example, Japanese Patent Application (OPI) Nos. 33826/73 (corresponding to U.S. Pat. No. 3,928,311); 54021/79; 113624/76 (corresponding to U.S. Pat. No. 4,055,428); and 71072/81.

In this invention it is preferred that an internal latent image-type direct positive silver halide emulsion layer has a dye-releasing redox compound associated therewith.

Also, as an immobile positive-type dye image-providing compound used in this invention, there is a compound which releases a diffusible dye without receiving any electron (i.e., without being reduced) or after receiving at least one electron (i.e., after being reduced) during photographic processing under an alkaline condition. Practical examples of the compound are described in, for example, Japanese Patent Application (OPI) Nos. 111628/74 (corresponding to U.S. Pat. No. 3,421,964); 63618/76 (corresponding to U.S. Pat. No. 3,980,479); 4819/77 (corresponding to U.S. Pat. No. 4,199,355); 69033/78; 110827/78 (corresponding to U.S. Pat. No. 4,139,379); 110828/78 (corresponding to U.S. Pat. No. 4,139,389); and 130927/79.

Furthermore, as a useful positive-type dye image-providing compound which is mobile from the first in an alkaline photographic processing condition, there is a dye developer. Typical examples thereof are described in Japanese Patent Publication Nos. 32130/73 (corresponding to U.S. Pat. No. 3,482,972) and 22780/80 (corresponding to U.S. Pat. No. 3,880,658).

The dye formed from the dye image-providing compound used in this invention may be a dye by itself or may be a dye precursor which can be converted into a dye in the photographic processing step or an additional processing step. Furthermore, the final image dye may be metallized or may not be metallized. Typical dye structures useful in this invention include metallized or non-metallized dyes such as azo dyes, azomethine dyes, anthraquinone dyes, phthalocyanine dyes, etc. In these dyes, azo series cyan, magenta, and yellow dyes are particularly important.

Practical examples of the yellow dye image-providing compound used in this invention are described in Japanese Patent Publication No. 2618/74 U.S. Pat. No. 3,309,199; Japanese Patent Publication No. 12,140/82; Japanese Patent Application (OPI) Nos. 114930/76; 111344/79; 16130/81; 71072/81; 79031/79; 64036/78; and 23527/79; U.S. Pat. Nos. 4,148,641 and 4,148,643; and *Research Disclosure,* 17630(1978); ibid., 16475(1977).

Practical examples of the magenta dye-providing compounds are described in U.S. Pat. No. 3,453,107; Japanese Patent Publication No. 43,950/71; Japanese Patent Application (OPI) No. 106727/77; U.S. Pat. Nos. 3,932,380; 3,931,144; and 3,932,308; Japanese Patent Application (OPI) Nos. 115,528/75; 106,727/77; 23628/78; 65034/79; 36804/80; 161332/79; 4028/80; 73057/81; 71060/81; 134/80; and U.S. Pat. Nos. 4,207,104 and 4,287,292.

Furthermore, practical examples of the cyan dye-providing compounds are described in Japanese Patent Publication No. 32130/73; Japanese Patent Application (OPI) Nos. 8827/77; 126331/74; 109928/76; 99431/79; 149328/78; 47823/78; 143323/78; 99431/79; 71061/81; 64035/78; and 121125/79; U.S. Pat. Nos. 4,142,891; 4,195,994; 4,147,544; and 4,148,642; European Pat. Nos. 53,037 and 53,040; *Research Disclosure,* 17,630(1978); ibid., 16,475(1975), and ibid., 16,475(1977).

Moreover, as one of the dye precursors, a dye-releasing redox compound having a dye moiety the light absorption of which is temporarily shifted in the light-sensitive element can be also used in this invention and practical examples thereof are described in Japanese Patent Application (OPI) Nos. 53330/80 and 53329/80; U.S. Pat. Nos. 3,336,287; 3,579,334; and 3,982,946; and British Pat. No. 1,467,317.

When the dye-releasing redox compound is used for processing the photographic element of this invention, any silver halide developing agent which can cross-oxidize the redox compound can be used. Such a developing agent may be incorporated in an alkaline processing composition or in a proper layer of the photographic element. Examples of the developing agent used for developing the photographic elements of this invention include hydroquinones; aminophenols; phenylene-diamines; pyrazolidinones (e.g., phenidone, dimmeson, 1-p-tolyl-4-methyl-4-hydroxymethyl-3-pyrazolidinone, 1-(4'-methoxyphenyl)-4-methyl-4-hydroxymethyl-4-pyrazolidinone, 1-phenyl-4-hydroxymethyl-3-pyrazolidinone, 1-p-tolyl-4,4-dihydroxymethyl-3-pyrazolidone, 1-m-tolyl-4-methyl-4-hydroxymethyl-3-pyrazolidone), etc., as described in U.S. Pat. No. 4,336,322. Also, as the developing agent used for silver salt diffusion transfer phtography, there are dydrocylamines described in U.S. Pat. Nos. 3,362,961; 3,293,034; 3,467,711; 3,491,151; 3,655,764; etc.

In the foregoing developing agents, a black and white developing agent (in particular, pyrazolidinones) having a property of reducing the formation of stain in an image-receiving layer is particularly preferred rather than a color developing agent such as phenylenediamines.

When using other dye image-providing compounds than the dye-releasing redox compound, an ordinary silver halide developing agent suitable for each dye image-providing agent may be used.

It is proper that the processing composition used for processing the photographic element of this invention has an alkalinity of higher than pH 9, preferably higher than pH 11.5 due to the presence of a base such as sodium hydroxide, potassium, hydroxide, sodium carbonate, sodium phosphate, etc. The processing composition may further contain an antioxidant such as sodium sulfite, an ascorbate, piperidinohexose reductant, etc., and a silver ion concentration controlling agent such as potassium bromide, etc. Moreover, the processing composition used in this invention may contain a viscosity increasing compound such as sydroxyethyl cellulose, sodium carboxymethyl cellulose, etc.

Furthermore, the alkaline processing composition may contain a compound having an action of accelerating the development or promoting the diffusion of dye, such as benzyl alcohol.

For the reproduction of natural color by a subtractive color process, a photographic material having at least two combinations each of a silver halide emulsion having a selective spectral sensitivity at a certain wave length region and a dye image-providing compound having a selective spectral absorption at the same wave length region is used.

In particular, a photosensitive element composed of a combination of a blue-sensitive silver halide emulsion and a yellow dye-releasing redox compound, a combination of a green-sensitive silver halide emulsion and a magenta dye-releasing redox compound, and a combination of a red-sensitive silver halide emulsion and a cyan dye-releasing redox compound is useful. These combination units of the silver halide emulsions and the dye-releasing redox compound may be coated in layers in face-to-face relationship in the photographic material or may be coated in one layer of a mixture of particles (each particle contains therein each dye-releasing redox compounds and each silver halide grain).

A scavenger for an oxidized developing agent can be used in various interlayers of the photographic elements of this invention. Examples of such materials are described in *Research Disclosure,* Vol. 151, pages 76–79 November, 1976).

Between an interlayer and a layer containing the dye image-providing compound may be formed aisolating layer as described in Japanese Patent Application (OPI) No. 52056/80. Also, a silver halide emulsion may be incorporated in an interlayer as described in Japanese Patent Application (OPI) No. 67850/81.

A mordanting or dyeable layer, a neutralizing layer, a processing composition, etc., used for the color diffusion transfer photographic materials of this invention are discribed in, for example; U.S. Pat. No. 4,268,625.

A polymer mordant in the image-receiving layer used in this invention is a polymer having a secondary or tertiary amino group, a polymer having a nitrogen-containing heterocyclic moiety, or a polymer having a quaternary cation group. The molecular weight of these polymers is higher than 5,000 and preferably higher than 10,000.

Practical examples of the mordant polymers used in this invention are vinylpyridine polymers and vinylpyridinium cation polymers disclosed in, for example, U.S. Pat. Nos. 2,548,564; 2,484,430; 3,148,061; 3,756,814; etc.; vinylimidazolium cation polymers disclosed in U.S. Pat. No. 4,124,386, etc.; polymer mordants crosslinkable with gelatin disclosed in U.S. Pat. Nos. 3,625,694; 3,859,096; and 4,128,538; British Pat. No. 1,277,453; aqueous sol-type mordants disclosed in U.S. Pat. Nos. 3,958,995; 2,721,852; and 2,798,063; Japanese Patent Application (OPI) Nos. 115228/79; 145529/79; 126027/79; 155835/79; 17352/81, etc.; water-insoluble mordants disclosed in U.S. Pat. No. 3,898,088; reactive mordants capable of performing covalent bonding with dyes disclosed in U.S. Pat. Nos. 4,168,976; 4,201,840, etc.; and the mordants disclosed in U.S. Pat. Nos. 3,709,690; 3,788,855; 3,642,482; 3,488,706; 3,557,066; 3,271,147; and 3,271,148; Japanese Patent Application (OPI) Nos. 30328/78; 155528/77; 125/78; 1024/78; and 107853/78; British Pat. No. 2,064,802, etc.

Other mordants described in U.S. Pat. Nos. 2,675,316 and 2,882,156 can be used in this invention.

In a preferred image-receiving layer for mordanting an azo dye having a chelating group, a polymer capable of immobilizing a transition metal ion and the transition metal ion are incorporated in the mordanting layer or a layer adjacent to the mordanting layer. Examples of the polymer capable of immobilizing a transition metal ion are described in Japanese Patent Application Nos. 48210/80 and 129346/80; U.S. Pat. Nos. 4,273,853 and 4,282,305.

Acid polymer used for the neutralization layer include the following materials.

A preferred acid material is a material having an acid group (or a precursor group giving such an acid group by a hydrolysis) of pKa of lower than 9. Examples of such preferred acid material are higher fatty acids such as oleic acid described in U.S. Pat. No. 2,983,606; polymers of acrylic acid, methacrylic acid, or maleic acid and the partial esters or acid anhydrides thereof as disclosed in U.S. Pat. No. 3,362,819; copolymers of acrylic acid and acrylic acid esters as disclosed in French Pat. No. 2,290,699; and latex-type acid polymers as disclosed in U.S. Pat. No. 4,139,383 and *Research Disclosure,* No. 16102 (1977).

Other acid materials disclosed in U.S. Pat. No. 4,088,493; Japanese Patent Application (OPI) Nos. 153739/77; 1023/78; 4540/78; 4541/78; 4542/78, etc., can be used in this invention.

Practical examples of the acid polymer used in this invention include a copolymer of maleic anhydride and a vinyl monomer such as ethylene, vinyl aceteta, vinyl methyl ether, etc., the n-butyl half ester of the copolymer, a copolymer of butyl acrylate and acrylic acid, cellulose.acetate.hydrogen phthalate, etc.

The following examples are intended to illustrate the present invention but not to limit it in any way.

EXAMPLE 1

A cover sheet was prepared by coating, in succession, the following layers (1) to (3) on a transparent polyethylene terephthalate support:

(1) A layer containing 11 g/m$^2$ of a copolymer of acrylic acid and butyl acrylate of 80:20 by weight ratio and 0.22 g/m$^2$ of 1,4-bis(2,3-epoxypropoxy)butane.

(2) A layer containing 4.3 g/m$^2$ of acetyl cellulose (forming 36.6 g of acetyl group by the hydroliysis of 100 g of the acetylcellulose), 0.23 g/m$^2$ of a methanol ring-open product of a copolymer (molecular weight of about 50,000) of styrene and maleic anhydride of 60:40 by weight ratio, and 2.6 meq./m$^2$ of the compound described in Table 1 as a development inhibitor precursor.

(3) A layer of 2$\mu$ in thickness formed by coating a mixture of a copolymer latex of styrene, n-butyl acrylate, acriylic acid, and N-methylolacrylamide (49.7/42.3/3/5) and a copolymer latex of methylmethacrylate, acrylic acid, and N-methylolacrylamide (93/4/3 by weight ratio) at a solid component ratio of the former latex to the latter latex of 6:4.

The neutralization timing time of each cover sheet thus prepared was measured by the following manner.

pH Indicator-coated film

A pH indicator-coated film was prepared by coating the following layers on a transparent polyethylene terephthalate support:

(1) An indicator layer containing 0.2 g/m$^2$ of Thymolphthalein and 7 g/m$^2$ of gelatin.

(2) A white reflecting layer containing 20 g/m$^2$ and 2 g/m$^2$ of gelatin.

(3) An indictor layer having the same composition as the layer (1).

Processing solution

Carboxymethyl cellulose Na-salt: 40 g

Potassium hydroxide: 42 g

Water: 918 g

Each cover sheet described above was superposed on the foregoing indicator-coated film and the processing solution having the foregoing composition was spread between them at a thickness of 80$\mu$. Then, the density was measured from the side of the pH indicator-coated film and a time required for reducing by half the reflection density of the high pH color (blue) of Thymolphthalein by the neutalization (the time is called "neutralization timing time") was measured at 25° C. The results are show in Table 1.

TABLE 1

| Cover Sheet No. | Compound | Neutralization Timing Time (min.) | Δt (min.) |
|---|---|---|---|
| 1 | — | 5.1 | — |
| 2 | PT—S—$CH_2CH_2CN$ | 7.1 | 2.0 |
| 3 | PT—S—$CH_2CH_2C(=O)$—$CH_3$ | 5.3 | 0.2 |
| 4 | PT—$SCH_2CH_2SO_2$— 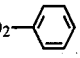 | 8.7 | 3.6 |
| 5 | Compound 5 | 5.1 | 0 |
| 6 | Compound 11 | 5.2 | 0.1 |

In Table 1, PT represents

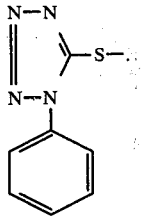

The compound used for cover sheet No. 2 is described in U.S. Pat. No. 4,009,029, the compound for cover sheet No. 3 in U.S. Pat. No. 3,260,597, and the compound for cover sheet No. 4 in Japanese Patent Application (OPI) No. 138745/80 and these cover sheets are for comparison.

Δt (min.) is the difference between the neutralization timing time of cover sheet No. 1 containing no development inhibitor precursor and that of cover sheet Nos. 2 to 6 containing a development inhibitor precursor.

It is understood that the use of the compound of this invention scarecely gives a delay (Δt) of the neutralization timing time as compared with comparison cover sheets No. 2 and No. 4.

EXAMPLE 2

A light-sensitive sheet was prepared by coating the following layers on a transparent polyethylene terephthalate film support:

(1) A mordanting layer containing 3.0 g/m$^2$ of gelatin and 3.0 g/m$^2$ of the following polymer latex mordant;

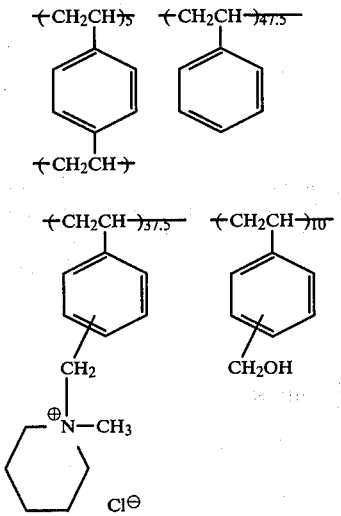

(2) A white reflecting layer containing 18 g/m$^2$ of titanium dioxide and 2.0 g/m$^2$ of gelatin.

(3) A light-shielding layer containing 2.0 g/m$^2$ of carbon black and 1.0 g/m$^2$ of gelatin.

(4) A layer containing 0.44 g/m$^2$ of the cyan dye-releasing redox compound having the following structure, 0.09 g/m$^2$ of tricyclohexyl phosphate, 0.008 g/m$^2$ of 2,5-di-t-pentadecylhydroquinone, and 0.8 g/m$^2$ of gelatin.

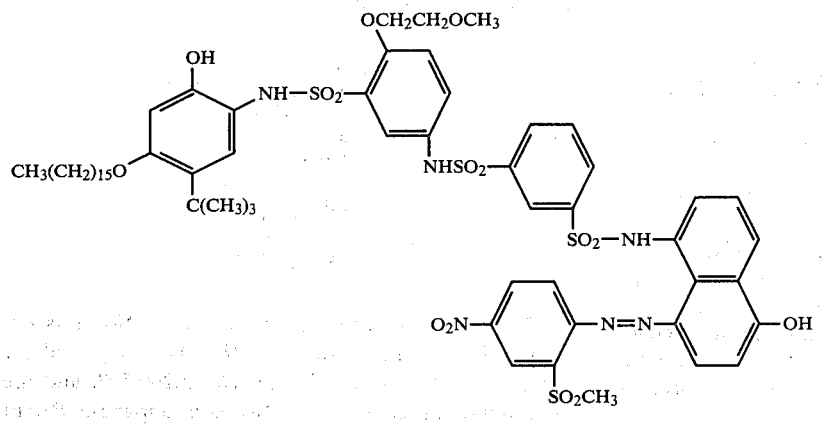

(5) A red-sensitive silver halide emulsion layer containing 1.03 g/m$^2$ (as a silver amount) of a red-sensitive internal latent image-type direct positive silver bromide emulsion, 1.2 g/m$^2$ of gelatin, 0.04 mg/m$^2$ of the nucleating agent having the following structure, and 0.13 g/m$^2$ of 2-sulfo-5-n-pentadecylhydroquinone.sodium salt.

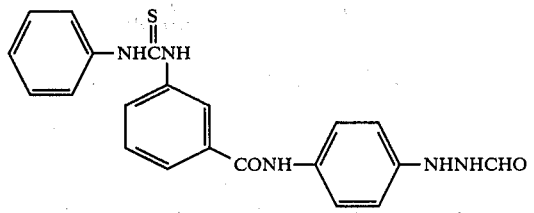

(6) A layer containing 0.43 g/m$^2$ of 2,5-di-t-pentadecyl-hydroquinone, 0.1 g/m$^2$ of trihexyl phosphate, and 0.4 g/m$^2$ of gelatin.

(7) A layer containing 0.21 g/m$^2$ of the magenta dye-releasing redox compound having the following structural formula A, 0.11 g/m$^2$ of the magenta dye-reasing redox compound having the following structural formula B, 0,08 g/m$^2$ of tricyclohexyl phosphate, 0.009 g/m$^2$ of 2,5-di-t-pentadecylhydroquinone, and 0.9 g/m$^2$ of gelation.

Structural formula A

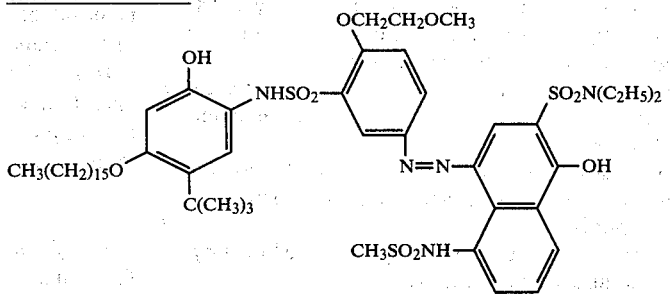

Structural formula B

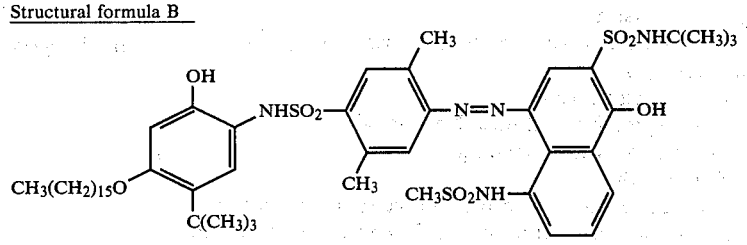

(8) A green-sensitive silver halide emulsion layer containing 0.82 g/m$^2$ (as a silver amount) of a green-sensitive internal latent image-type direct positive silver halide emulsion, 0.9 g/m$^2$ of gelatin, 0.03 mg/m$^2$ of the nucleating agent having the same structure as in layer (5), and 0.08 g/m$^2$ of 2-sulfo-5-n-pentadecylhydroquinone.sodium salt.

(9) A layer having the same composition as layer (6).

(10) A layer containing 0.53 g/m$^2$ of the yellow dye-releasing redox compound having the following structure, 0.13 g/m$^2$ of tricyclohexyl phosphate, 0.014 g/m$^2$ of 2,5-di-t-penta-decylhydroquinone, and 0.7 g/m$^2$ of gelatin.

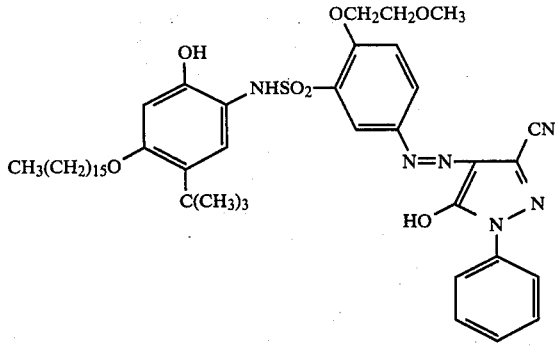

(11) A blue-sensitive silver halide emulsion containing 1.09 g/m$^2$ (as a silver amount) of a blue-sensitive internal latent image-type direct positive silver bromide emulsion, 1.1 g/m$^2$ of gelatin, 0.04 mg/m$^2$ of the nucleating agent having the same structure as in layer (5), and 0.07 g/m$^2$ of 2-sulfo-5-n-pentadecylhydroquinone.-sodium salt.

(12) A layer containing 1.0 g/m$^2$ of gelatin.

The foregoing light-sensitive sheet was exposed through a fine line test chart for sharpness evaluation, superposed on the cover sheet prepared in Example 1, and the processing liquid having the following composition was spread between them at a thickness of 85$\mu$ at 25° C. After being allowed to stand for one day, the sharpness was measured through a green filter by means of a microdensitometer and the space frequency that C. T. F. became 0.5 is shown in Table 2.

Processing liquid:

| | |
|---|---|
| 1-p-Tolyl-4-hydroxymethyl-4-methyl-3-pyrazolidone | 6.9 g |
| Methylhydroquinone | 0.3 g |
| 5-Methylbenzotriazole | 3.5 g |
| Sodium sulfite (anhydrous) | 0.2 g |
| Carboxymethyl cellulose sodium salt | 58 g |
| Potassium hydroxide (28% aqueous soln.) | 200 ml |
| Benzyl alcohol | 1.5 ml |
| Carbon black | 150 g |
| Water | 685 ml |

TABLE 2

| Cover sheet No. | Space frequency when C. T. F. becomes 0.5 |
|---|---|
| 1 (blank) | 3.0 |
| 2 (comparison) | 2.3 |
| 3 (comparison) | 2.8 |
| 4 (comparison) | 2.3 |
| 5 (Invention) | 2.8 |
| 6 (Invention) | 2.8 |

From the results, it is understood that the use of the compound of this invention provided transferred images having a good sharpness and a high image quality as compared to Comparison examples 2 and 4.

EXAMPLE 3

After exposing the light-sensitive sheet prepared by the same manner as in Example 2 through a color test chart, the cover sheet as in Example 1 was superposed on the light-sensitive sheet and the foregoing processing liquid (Example 2) was spread between both sheets (by means of a press roller) at a thickness of 85$\mu$ at a temperature of 35° C.

The maximum density and the minimum density of the transferred color image are shown in Table 3. From the results, it is understood that the compounds of this invention can restrain the minimum density at a low value with almost no reduction of the maximum density.

In particular, in the comparison example, cover sheet 3 which did not delay the neutralization timing time, the development inhibitor was released too fast, whereby the maximum density was sacrificed. Thus, the profitability of this invention is clear as compared to the comparison example.

TABLE 3

| | Maximum density | | | Minimum density | | |
|---|---|---|---|---|---|---|
| Cover sheet No. | Blue | Green | Red | Blue | Green | Red |
| 1 (Blank) | 1.99 | 2.30 | 2.28 | 0.31 | 0.29 | 0.45 |
| 2 (Comparison example) | 2.00 | 2.33 | 2.32 | 0.25 | 0.23 | 0.36 |
| 3 (Comparison example) | 1.72 | 2.22 | 2.35 | 0.23 | 0.22 | 0.35 |
| 4 (Comparison example) | 1.95 | 2.31 | 2.34 | 0.23 | 0.22 | 0.35 |
| 5 (This invention) | 1.95 | 2.26 | 2.31 | 0.23 | 0.21 | 0.35 |
| 6 (This invention) | 1.96 | 2.26 | 2.32 | 0.23 | 0.21 | 0.35 |

While the invention has been described in detail and with reference to specific embodiments thereof, it will be apparent to one skilled in art that various changes and modifications can be made therein without departing from the spirit and the scope thereof.

What is claimed is:

1. A photographic element, comprising:

a support having thereon;

a light-sensitive silverhalide emulsion layer having associated therewith;

a development inhibitor precursor represented by general formula [I]

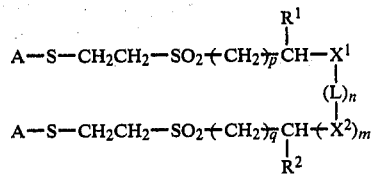

[I]

wherein A represents a substituted or unsubstituted phenyl group or 5-membered or 6-membered nitrogen-containing heterocyclic ring; $R^1$ and $R^2$, which may be the same or different, each represents a hydrogen atom or an alkyl group having 1 to 4 carbon atoms; p and q, which may be the same or different, each is 0 or an integer of 1 to 3; $X^1$ and $X^2$, which may be the same or different, each represents an ester bond, a substituted or unsubstituted amido bond, or an ether bond; when said $X^1$ and $X^2$ are amido groups, the substituents on the nitrogen atoms may combine with each other to form a heterocyclic ring together with L and the moiety of each $X^1$ and $X^2$; L represents and alkylene group, a phenylene group, or a xylylene group; and n and m are 0 or 1.

2. A photographic element as claimed in claim 1, wherein the development inhibitor precursor is a compound represented by general formula [II]

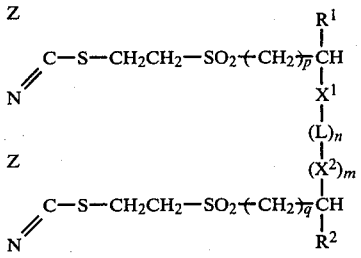

[II]

wherein Z represents a non-metallic atomic group necessary for completing a 5-membered or 6-membered nitrogen-containing heterocyclic ring and $R^1$, $R^2$, $X^1$, $X^2$, L, m, n, p, and q have the same significance as defined in claim 1 with respect to general formula [I].

3. A photographic element as claimed in claim 1, wherein A of general formula [I] is a tetrazole ring.

4. A photographic element as claimed in claim 3, wherein the tetrazole ring is a 1-phenyltetrazole ring.

5. A photographic element as claimed in claim 1, wherein the photographic element is a color diffusion transfer photographic element, further containing an image-receiving layer on a same or different support from the support having thereon a silver halide emulsion layer.

6. The photographic element as claimed in claim 5, wherein the color diffusion transfer photographic element further contains an alkaline processing composition for developing the imagewise exposed silver halide; and a neutratizing system for neutralizing said alkaline processing composition.

7. The photographic element as claimed in claim 6, wherein the development inhibitor precuesor is incorporated in the nutrilizing system.

8. The photographic element as claimed in claim 6, wherein the color diffusion transfer photographic element comprises a light-sensitive sheet comprising a transparent suppot having thereon an image-receiving element for fixing diffusible dyes to form a color image, a white reflecting layer, a light-shielding layer and a light-sensitive element comprising at least one silver halide emulsion layer having associated therewith a dye image-providing compound; an alkaline processing ccomposition for developing the imagewise exposed light-sensitive element; and a cover sheet comprising another support having thereon a neutralizing system for neutralizing the alkaline processing composition, the development inhibitor precursor being incorporated in the cover sheet.

9. The photographic element as claimed in claim 1, wherein said silver halide emulsion is an internal latent image-type direct positive silver halide emulsion.

10. The photographic element as claimed in claim 1, wherein the dye image-providing compound associated with the internal latent image-type direct positive emulsion is a dye releasing redox compound.

11. A photographic element as claimed in claim 2, wherein the development inhibitor precursor is represented by the general formula [III]

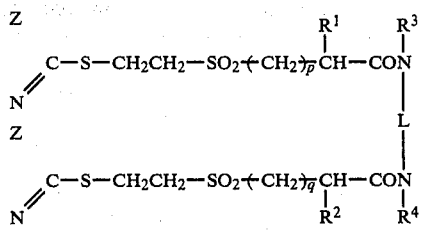

[III]

wherein Z, $R^1$, $R^2$, L, p and q have the same significance as difined in claim 2 with respect to general formula [II] and $R^3$ and $R^4$ each represent a hydrogen atom, an alkyl group having 1 to 4 carbon atoms or a phenyl group.

12. A photographic element as claimed in claim 1, wherein the development inhibitor precursor is present in an amount of $10^{-5}$ mol or more based on one mol of silver.

13. A photographic element as claimed in claim 1, wherein the development inhibitor precursor is present in an amount in tjhe range of $10^{-4}$ mol to $10^{-1}$ mol based on one mol of silver.

* * * * *